US010849375B1

(12) United States Patent
Bowen et al.

(10) Patent No.: US 10,849,375 B1
(45) Date of Patent: Dec. 1, 2020

(54) PERIMETER SEAL FOR A FACE MASK

(71) Applicant: Prestige Ameritech, Ltd., North Richland Hills, TX (US)

(72) Inventors: Michael L. Bowen, North Richland Hills, TX (US); Richard Bennett, Flower Mound, TX (US)

(73) Assignee: Prestige Ameritech, Ltd., North Richland Hills, TX (US)

( * ) Notice: Subject to any disclaimer, the term of this patent is extended or adjusted under 35 U.S.C. 154(b) by 0 days.

(21) Appl. No.: 16/849,203

(22) Filed: Apr. 15, 2020

Related U.S. Application Data

(60) Provisional application No. 62/993,450, filed on Mar. 23, 2020, provisional application No. 63/005,073, filed on Apr. 3, 2020.

(51) Int. Cl.
*A41D 13/11* (2006.01)

(52) U.S. Cl.
CPC ..... *A41D 13/1176* (2013.01); *A41D 13/1115* (2013.01); *Y10T 428/14* (2015.01); *Y10T 428/149* (2015.01)

(58) Field of Classification Search
CPC ..... A41D 13/1176; A41D 13/1115; Y10T 428/14
See application file for complete search history.

(56) References Cited

U.S. PATENT DOCUMENTS 4,890,608 A * 1/1990 Steer ..... A61F 5/443 602/52
5,826,582 A * 10/1998 Sheehan ..... A61B 5/12 128/864
5,918,598 A * 7/1999 Belfer ..... A41D 13/1176 128/205.25
6,196,223 B1 * 3/2001 Belfer ..... A41D 13/1176 128/205.25
6,308,330 B1 * 10/2001 Hollander ..... A41D 13/1176 128/206.14
7,017,577 B2 * 3/2006 Matich ..... A62B 18/08 128/206.14
8,381,727 B2 * 2/2013 Matich ..... A41D 13/1138 128/206.14
2002/0104543 A1 * 8/2002 Hollander ..... A41D 13/1176 128/205.29
2004/0231023 A1 * 11/2004 Huang ..... A41D 13/1176 2/9
2005/0161046 A1 * 7/2005 Michaels ..... A62B 23/06 128/206.14

(Continued)

*Primary Examiner* — Patricia L. Nordmeyer

(74) *Attorney, Agent, or Firm* — Betsy Kingsbury Dowd, Esq.; BKDowd Law, P.C.

(57) ABSTRACT

A perimeter seal device is constructed in three layers to easily convert a non-sealed face mask to a face mask with a perimeter seal. The device has a top and bottom release liner, partitioned for providing the perimeter seal to an existing manufactured mask, with a double-sided adhesive layer in the middle formed with pressure-sensitive adhesive. A pre-cut perimeter portion of the adhesive layer provides the perimeter seal. The construction of the perimeter seal device allows alternate methods for fixing either side of the perimeter portion of the adhesive layer onto a face mask. The opposing side of the adhesive perimeter portion is adhered directly on a wearer's face. The device provides a way to convert a surgical or other non-sealed face mask to a sealed mask.

10 Claims, 17 Drawing Sheets

(56) References Cited

U.S. PATENT DOCUMENTS

| | | | | |
|---|---|---|---|---|
| 2007/0212509 | A1* | 9/2007 | Herbig | G09F 3/10 428/40.1 |
| 2008/0110469 | A1* | 5/2008 | Weinberg | A41D 13/1176 128/863 |
| 2009/0211582 | A1* | 8/2009 | Reese | A41D 13/1107 128/206.21 |
| 2014/0224261 | A1* | 8/2014 | Tsuei | A41D 13/1115 128/863 |
| 2017/0360125 | A1* | 12/2017 | Tuan | A41D 13/1115 |

* cited by examiner

PERIMETER SEAL FOR A FACE MASK

CROSS-REFERENCE TO RELATED APPLICATION

This application claims the benefit of and priority to each of U.S. Provisional Application Ser. No. 63/005,073, entitled PERIMETER SEAL FOR A FACE MASK, filed Apr. 3, 2020, and U.S. Provisional Application Ser. No. 62/993,450, entitled PERIMETER SEAL FOR A FACE MASK, filed Mar. 23, 2020, the entirety of each of which is hereby incorporated herein by reference thereto.

FIELD OF DISCLOSURE

The present disclosure relates generally to face masks and, in particular, to face masks with a perimeter seal.

BACKGROUND

Face masks used in the health industry are generally of two types: surgical masks intended to act primarily as a barrier to splashes, droplets and spit and to protect the patient from infection, and respirators used by healthcare workers and others as personal protection equipment to additionally enhance protection of the face mask wearer from exposure to infection. Both are constructed with filtering media that covers the nose and mouth of the wearer, so that any air passing in or out of the wearer's mouth and nose through the filtering media is filtered from biological aerosols such as bacteria and viruses. Surgical masks do not typically have a seal to seal a perimeter of the face mask to one's face. A respirator is a face mask constructed with filtering media having a high filtration efficiency and an added seal to seal the perimeter of the filter media tight to the wearer's face. The seal is commonly built into the face mask by using an elasticized border, silicone or rubberized gaskets, or by other means, to minimize or preferably eliminate any flow of unfiltered air through gaps between the wearer's face and the periphery of the filtering media.

U.S. Pat. No. 7,017,577 discloses using pressure-sensitive adhesive applied directly to the perimeter of a non-sealed face mask and then adhering the mask directly to the wearer's skin. The adhesive may be directly applied from a tube, or strips of tape may be adhered to the face mask perimeter. The strips of tape have a release layer that is peeled off after the tape is applied to the perimeter of the mask, revealing an adhesive that is then sealed directly to the face.

For the protection of healthcare workers, there is a need for a method and device for quickly converting a face mask manufactured with no seal (also referred to herein as a "non-sealed" face mask) to a sealed face mask, or respirator, in the event that pre-manufactured respirators are not readily available. There is also a need for a device for converting a non-sealed face mask to a sealed face mask that can be efficiently and quickly manufactured.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a method and device for providing a perimeter seal for a face mask and for quickly converting an existing pre-manufactured non-sealed face mask to a sealed face mask for enhanced protection of the wearer from biological aerosols. The present disclosure is also directed to a method for manufacturing a perimeter seal for a face mask.

The present disclosure is also directed to a perimeter seal device for forming a perimeter seal for a face mask, which includes a top release liner, an adhesive layer, and a bottom release liner, wherein the adhesive layer is sandwiched between the top release liner and the bottom release liner. The top release liner includes a perimeter portion and a central portion. The adhesive layer includes a carrier with an upper surface and a lower surface, with a pressure-sensitive adhesive coated on each of the upper surface and the lower surface. The adhesive layer also includes a perimeter portion and a central portion aligned with the perimeter portion and the central portion of the top release liner, respectively. The perimeter portion of the adhesive layer is separable from each of the central portion of the adhesive layer, the top release liner, and the bottom release liner to form a perimeter seal for a face mask.

In aspects, the perimeter seal device includes a perimeter cut extending from an upper surface of the top release liner through the lower surface of the adhesive layer, the perimeter cut defining the perimeter portion in each of the top release liner and the adhesive layer.

In aspects, the bottom release liner adhesive layer includes a peel portion that extends beyond a perimeter of the adhesive layer, wherein the peel portion is adhesive-free.

The top release liner further includes, in aspects, a cut therethrough, which does not extend through the adhesive layer, to provide a crack-and-peel edge, the cut and crack-and-peel edge extending from a perimetral edge of the top release liner to the perimeter cut.

Each of the top release liner, the adhesive layer, and the bottom release liner may be rectangular-shaped, in further aspects, with the peel portion extending beyond the perimeter of the adhesive layer along at least one edge of the adhesive layer.

In some aspects, the bottom release liner is centered to the upper release liner and the adhesive layer, with the peel portion extending beyond two edges of the adhesive layer.

In some aspects, each of the top release liner, the adhesive layer, and the bottom release liner is oval-shaped.

At least the perimeter portion of the adhesive layer provides a perimetral strip configured and shaped to provide a perimeter seal on the periphery of a face mask to which the perimeter seal is adhered.

In aspects, the carrier providing the adhesive layer is a stretchable plastic film.

In further aspects, each of the top release liner and the bottom release liner includes one of a paper sheet and a plastic film, silicone-coated on at least one side, wherein the top release liner is silicone-coated on a lower surface, and the bottom release liner is silicone-coated on an upper surface.

In additional aspects, one of an upper surface of the top release liner and a bottom surface of the bottom release liner may include a two-dimensional bar code printed thereon.

In aspects, the bottom release liner includes a peel portion that extends beyond a perimeter of the adhesive layer, the top release liner is silicone-coated on a lower surface, and the bottom release liner is silicone-coated on an upper surface, and the carrier of the adhesive layer is formed of polyethylene and the pressure-sensitive adhesive includes a medical grade acrylic The perimeter seal device is configured to adhere either one of the upper surface and the lower surface of the perimeter portion of the adhesive layer to the face mask to form the perimeter seal on the face mask, in accordance with methods of the present disclosure.

The present disclosure is also directed to a method for providing a face mask with a perimeter seal, the method including providing a perimeter seal device which includes an adhesive layer coated on each of a lower surface and an upper surface with pressure-sensitive adhesive, the adhesive layer being sandwiched between a top release liner and a bottom release liner.

The method further includes exposing the pressure-sensitive adhesive on the lower surface of a perimeter portion of the adhesive layer, including peeling intact a two-layer perimetral strip portion of the perimeter seal device off of the bottom release liner. The two-layer perimetral strip portion includes a perimeter portion of the top release liner layered on the perimeter portion of the adhesive layer. The perimeter portion of the adhesive layer forms the perimeter seal for attaching to a face mask.

In aspects, the method includes adhering, by pressing, the two-layer perimetral strip portion onto a periphery of a user-facing side of the face mask via the pressure-sensitive adhesive on the lower surface of the perimeter portion of the adhesive layer; and removing the perimeter portion of the top release liner to expose the pressure-sensitive adhesive on the upper surface of the adhesive layer.

The method may further include, in aspects, after the removing step, adhering the face mask with the perimeter portion of the adhesive layer adhered thereto to a wearer's face via the pressure-sensitive adhesive exposed on the upper surface of the adhesive layer.

In aspects, removing the perimeter portion of the top release liner may include cracking and peeling the top release liner along a cut line that extends across a width of the perimeter portion of the top release liner.

Peeling intact the two-layer perimetral strip portion may include, in aspects, peeling an edge of the two-layer perimetral strip portion along a peel portion of the bottom release liner that extends beyond a perimeter of the adhesive layer.

In further aspects, the perimeter portion of each of the adhesive layer and the top release liner may be peeled away along a perimeter cut formed through both the adhesive layer and the top release liner, leaving a central portion of each of the adhesive layer and the top release liner layered on the bottom release liner.

The present disclosure is also directed to a method for providing a face mask with a perimeter seal, including providing a perimeter seal device which includes an adhesive layer coated on each of a lower surface and an upper surface with pressure-sensitive adhesive, the adhesive layer being sandwiched between a top release liner and a bottom release liner. The method further includes exposing the pressure-sensitive adhesive on the upper surface of a perimeter portion of the adhesive layer, including peeling off and removing a perimeter portion of the top release liner; adhering, by pressing, after the exposing step, the perimeter seal device onto a periphery of the face mask via the pressure-sensitive adhesive exposed on the upper surface of the perimeter portion of the adhesive layer; and peeling away the bottom release liner to expose the pressure-sensitive adhesive on the lower surface of the adhesive layer. The perimeter portion of the adhesive layer forms the perimeter seal for the face mask.

In aspects, the peeling off and removing the perimeter portion of the top release liner may include peeling away the perimeter portion along a perimeter cut through the top release liner, leaving a central portion of the top release liner intact. The perimeter cut extends through the adhesive layer to define the perimeter portion and a central portion of the adhesive layer.

In aspect, the method further includes removing, after the peeling step, the central portion of both the adhesive layer and the top release liner, the perimeter portion of the adhesive layer remaining on the mask to provide the perimeter seal.

In further aspects, after the removing step, the method includes adhering the face mask with the perimeter portion of the adhesive layer adhered thereto to a wearer's face via the pressure-sensitive adhesive exposed on the lower surface of the perimeter portion of the adhesive layer.

In aspects, the peeling off and removing the perimeter portion of the top release liner includes cracking and peeling the top release liner along a cut line that extends across a width of the perimeter portion of the top release liner.

In some aspects, peeling away the bottom release liner may include peeling an edge of the bottom release liner along a peel portion that extends beyond a perimeter of the adhesive layer.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the detailed description in conjunction with the accompanying drawings, which are briefly described below.

Figure 1:
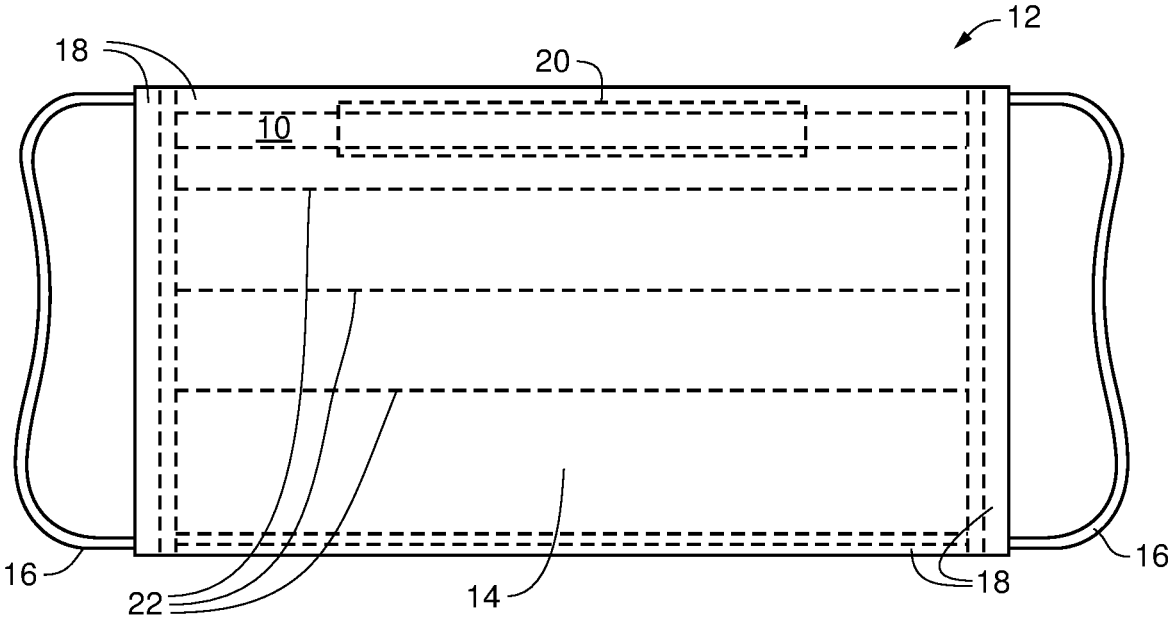
FIG. 1 PRIOR ART
FIG. 1 is a pictorial view of a rear, user-facing side of a prior art face mask with no seal.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings. The disclosed embodiments are merely examples of the invention, which may be embodied in various forms. It should be apparent to those skilled in the art that the embodiments described are illustrative only and not limiting, having been presented by way of example only. All features disclosed in this description may be replaced by alternative features serving the same or similar purpose, unless expressly stated otherwise. Therefore, numerous other modifications thereof are contemplated as falling within the scope of the present disclosure of a perimeter seal for a face mask as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The present disclosure is directed to a method and device for providing a perimeter seal for a face mask and for quickly converting a non-sealed face mask to a sealed face mask for enhanced protection of the wearer from biological aerosols. The present disclosure is also directed to a method for manufacturing the perimeter seal device of the disclosure.

FIG. 1 is a pictorial view of a rear, or user-facing side of a typical prior art face mask 12 manufactured with no seal. The face mask 12 includes an air-filtering portion 14, and may include ear loops 16 attached to a periphery 18 of the face mask 12 for positioning and retaining the air-filtering portion 14 over a mouth and nose of a wearer. The face mask 12 shown in FIG. 1 is typically referred to as an "ear loop mask." The air-filtering portion 14 may also include a plurality of pleats 22 that allow vertical expansion of the air-filtering portion 14 upon donning of the face mask 12 to cover a nose and mouth of a wearer and, preferably, to extend beyond the chin in a vertical direction. The peripheral edges of the air-filtering portion 14, which is typically a multi-layered construction, are typically bonded, adhered, stitched, or otherwise secured together, but no seal is provided for sealing to a wearer's face. Most prior art face masks also include a bendable nose strip 20 either attached to an outside surface of the face mask 12 or sewed into an internal pocket for better conformation of the face mask 12 to contours of the face around the nose.

Figure 2A:
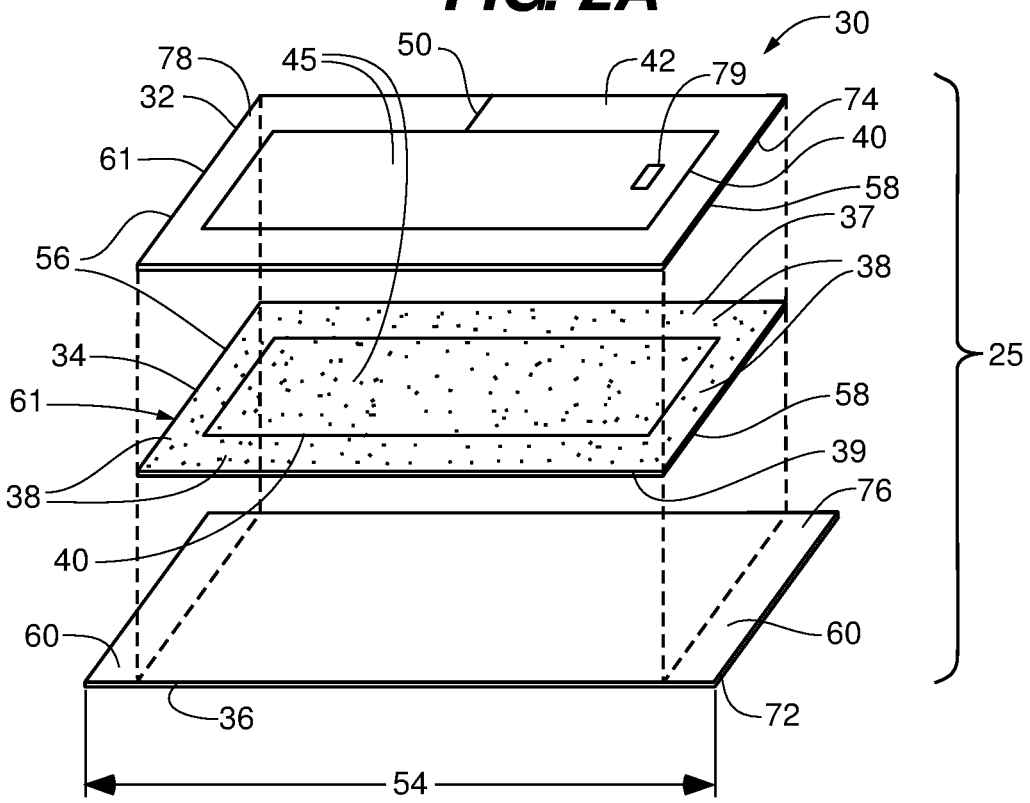
FIG. 2A is an exploded view of an embodiment of a perimeter seal device of the present disclosure for providing a face mask with a perimeter seal.

FIG. 2A is an exploded view of an embodiment of a perimeter seal device configured for sealing the face mask 12 of FIG. 1 directly to a wearer's face. In embodiments, the perimeter seal device can be configured to seal any prior art face mask, of any shape. In particular, it should be understood that while most of the embodiments of the perimeter seal device shown and described herein are shaped for sealing the rectangularly shaped prior art mask represented by FIG. 1, these embodiments are exemplary only and not limited thereto. It will be understood by one of skill in the art that embodiments of the perimeter seal device may be constructed as described herein in any appropriate shape to match a shape of a perimeter of any manufactured face mask for applying a seal thereto, including round or oval, with or without pleats, and so on, and are not limited to shapes or types of masks represented herein.

Figure 2B:
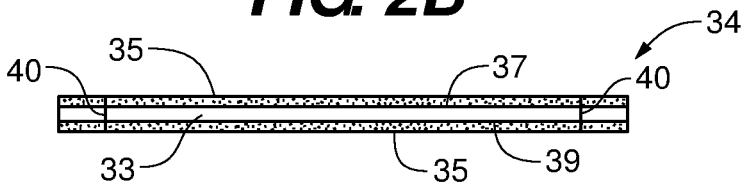
FIG. 2B is a side view representation of the adhesive layer, also referred to herein as the "middle adhesive layer," of FIG. 2A.
Figure 9:
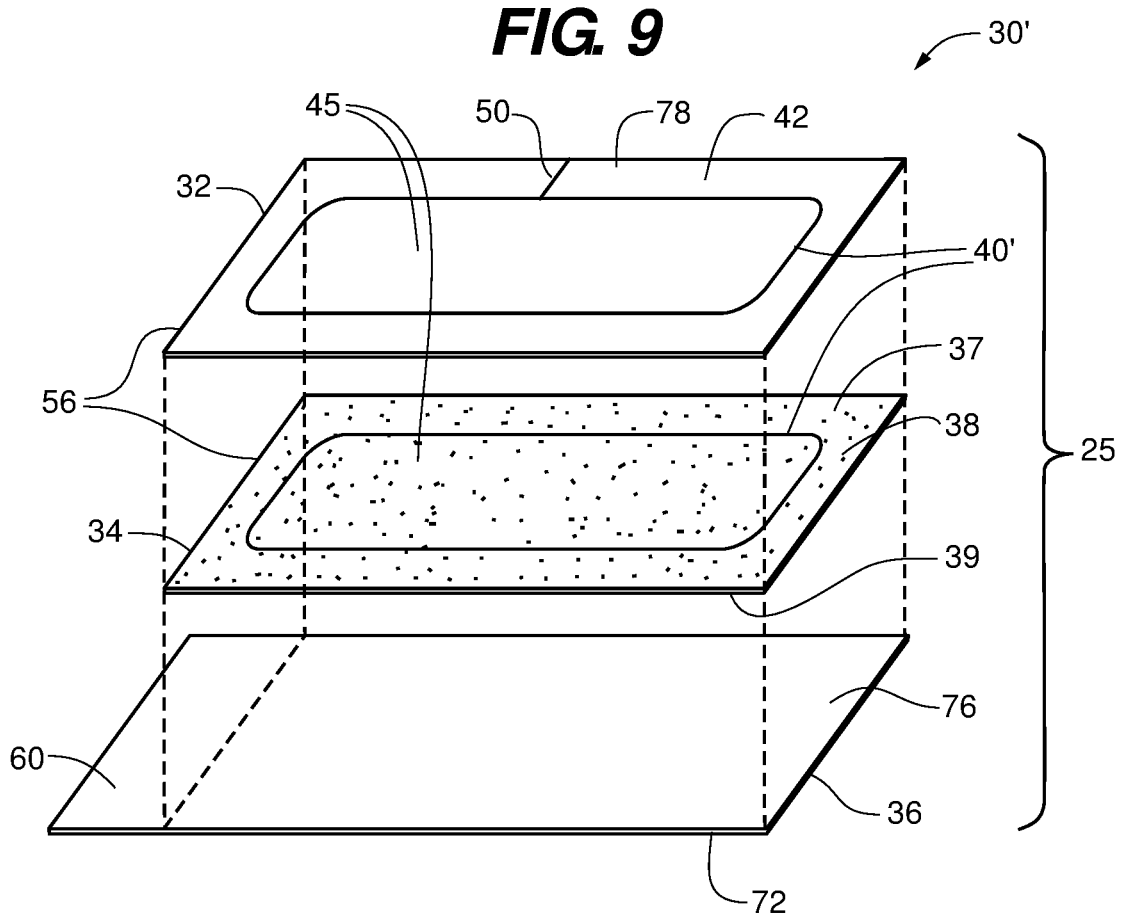
FIG. 9 is an exploded view of another embodiment of a perimeter seal device of the present disclosure for providing a face mask with a perimeter seal.

Referring to FIG. 2A as well as to FIG. 9, embodiments of the perimeter seal device for applying to a face mask include a three-layered structure 25 with the three layers sandwiched together in the manufacturing process. An exploded view of the three-layered structure 25 is shown in each of FIGS. 2A and 9. The three-layered structure 25 includes a top release liner 32 forming a top layer, and an adhesive layer 34, also referred to herein as a "middle adhesive layer," forming a middle layer. Referring also to FIG. 2B, the middle adhesive layer 34 includes a carrier 33, or substrate, with a pressure-sensitive adhesive 35 (also referred to herein as "PSA") layered on each of an upper surface 37 and a lower surface 39 of the substrate 33 of the adhesive layer 34, and, in embodiments, forms a two-sided releasable pressure-sensitive adhesive layer. The three-layered structure 25 also includes a bottom release liner 36 forming a bottom layer, which is, in embodiments, one continuous bottom release liner. As further described herein, a peel portion 60 of the bottom release liner 36 preferably extends beyond a perimeter of the adhesive layer 34, and in embodiments, also beyond a perimeter of the top release liner 32, which may be of the same outer dimensions as the adhesive layer 34, to provide an edge for easily peeling away the bottom release liner 36.

In embodiments, each of the top release liner 32 and the bottom release liner 36 is about 3.2 mils (millionths of an inch) thick. In further embodiments, each of the top release liner 32 and the bottom release liner 36 are silicone coated liners, with the silicone-coated side facing the adhesive layer 34.

Referring to FIG. 2B, for example, the middle adhesive layer 34 may be formed of a carrier 33 coated on both sides 37, 39 with a layer of the pressure-sensitive adhesive 35. The pressure-sensitive adhesive (PSA) 35 may include any suitable PSA for adhering to the skin. In embodiments, the PSA may include an acrylic adhesive of medical grade. In still other embodiments, the PSA may include a silicone or non-latex composition.

In embodiments, each of the layers of pressure-sensitive adhesive 35 are about 1.8 mil ("mil" refers to millionths of an inch) thick, and the carrier may be about 3 mils thick.

The carrier may be any suitable carrier, and in embodiments, may be a thin plastic film, and in further embodiments, a stretchable plastic film. In still further embodiments, the carrier is a polyethylene, in embodiments, a low density polyethylene (LDPE).

In embodiments, the carrier may include a polyethylene, polypropylene, polyester, or a polyurethane.

In additional embodiments, the carrier may be a foil, cloth, paper, or tissue material.

Various materials may be used to form the top release liner 32 and the bottom release liner 36. In embodiments, the release liners 32, 36, include a base or substrate 41 (see FIG. 12C), which may be formed, in embodiments, of paper, or of a plastic film. Suitable materials for the substrate may include, but are not limited to, paper materials such as Super Calendered Kraft ("SCK"), glassine, various types of coated paper, machine finished Kraft paper, and machine glazed paper; and plastic films such as terephthalate ("PET") typically extruded as a biaxially oriented PET film, or "BO-PET", polypropylene ("PP") which may be extruded as a biaxially oriented polypropylene ("BOPP") film, polyolefin, and polyethylene ("PET"). The substrate or "liner" is coated on at least one side with a release agent to form a release side from which an adhesive surface, i.e., the upper surface 37 or lower surface 39 covered with the PSA 35, can be separated.

In the three-layered structure 25 of the embodiments of the present disclosure, referring to FIG. 2A as well as 12C, for example, at least a lower surface 74 of the top release liner 32 that contacts the upper surface 37 of the middle adhesive layer 34 is coated with a release agent, such as silicone. Similarly, at least an upper surface 76 of the bottom release liner 36 that faces the lower surface 39 of the middle adhesive layer 34 is preferably coated with a release agent, such as silicone. In embodiments, the top release liner 32 of the device is silicone-coated on the lower surface 74, and the bottom release liner 36 is silicone-coated on upper surface 76.

In other embodiments, the lower surface 74 and upper surface 76 are coated with any suitable release agent.

In embodiments, referring still, for example, to FIG. 2A, either an upper surface 78 or the bottom surface 72 of the three-layered structure 25 may be printed with a two-dimensional bar code 79, e.g., a quick response "QR" code, which when scanned, opens up a website or application containing directions that a user can quickly access, with a video and instructions for applying the perimeter seal device 30, for example, to the face mask 12 to provide a perimeter seal 80 (see FIG. 8B) in accordance, for example, with methods described herein.

As further described herein, the three-layered structure 25 of the perimeter seal device is configured to transfer and adhere a perimeter portion 38 of the middle adhesive layer 34 to the perimeter 18 of the user-facing side 10 of a face mask, face mask 12, for example. It should be noted that "perimeter portion" as used herein refers to a perimetral strip configured to align with the peripheral shape and peripheral dimensions of a face mask, so that an adhesive seal of a width defined by the width of the perimeter portion or strip, is formed all around the periphery of the mask. A portion of the face mask 12 corresponding to the perimeter portion 38 adhered thereto is then adhered directly to a user's face via the pressure-sensitive adhesive 35 on an exposed surface of the perimeter portion 38 of the adhesive layer 34, as further described herein. As further described herein, the exposed surface for adhering to a user's face may be either the upper surface 37 or the lower surface 39 of the adhesive layer 34, depending on the method used to apply the perimeter portion 38 of the adhesive layer 34 to the face mask.

Figure 14A:
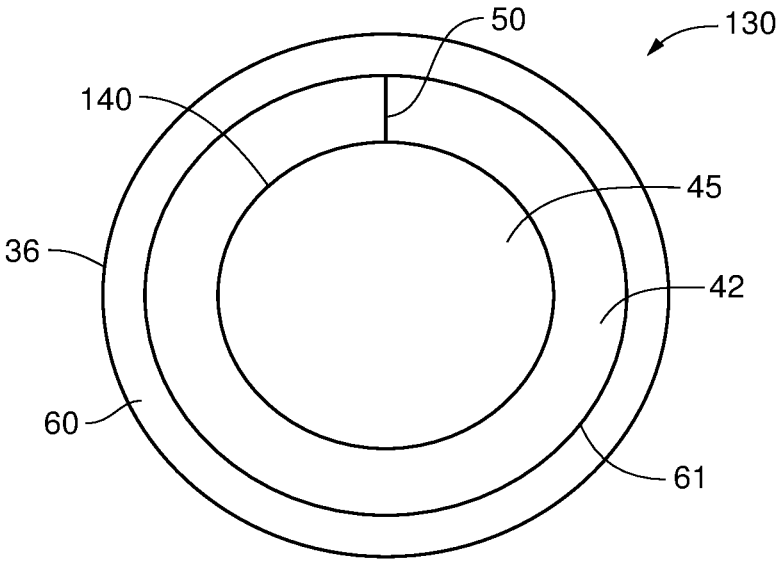
FIG. 14A is a top view of another embodiment of a perimeter seal device in accordance with the present disclosure.
Figure 14B:
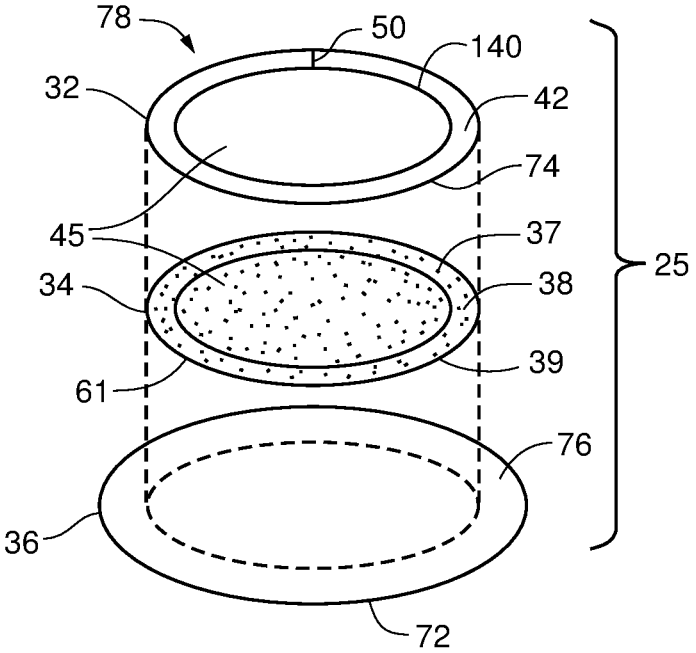
FIG. 14B is an exploded view of the embodiment of the perimeter seal device of FIG. 14A, prior to assembly to a face mask.

The embodiments shown in reference to FIG. 2A, as well as FIG. 9, are configured for use with a rectangular face mask, such as the ear loop mask 12 of FIG. 1, typically having dimensions of approximately 3.5"×7". Accordingly, the outer dimensions of the top release liner 32 and middle adhesive layer 34, in embodiments, are about 3.5"×7". Each of the top release liner 32 and adhesive layer 34 may be configured for any shape and size of face mask, and preferably have substantially the same perimeter dimensions as the face mask onto which it is assembled. Each of the top release liner 32 and middle adhesive layer 34 preferably has a perimeter cut 40 to define a perimeter portion 42 in the top release liner 32 and the perimeter portion 38 in the adhesive layer 34. In embodiments, the perimeter cut 40 may be of the same shape as the face mask itself, for example, rectangular, as shown in FIG. 2A, or, for example, a perimeter cut 140 may be oval-shaped, for an embodiment 130 of a perimeter seal device configured for an oval-shaped or round face mask, as shown in FIGS. 14A-14B.

In embodiments, referring to FIG. 2A, a central portion 45 of the top release liner 32 and adhesive layer 34 formed by the perimeter cut 40 is preferably centered to the edges of each of the top release liner 32 and middle adhesive layer 34 of the perimeter seal device 30.

Figure 3:
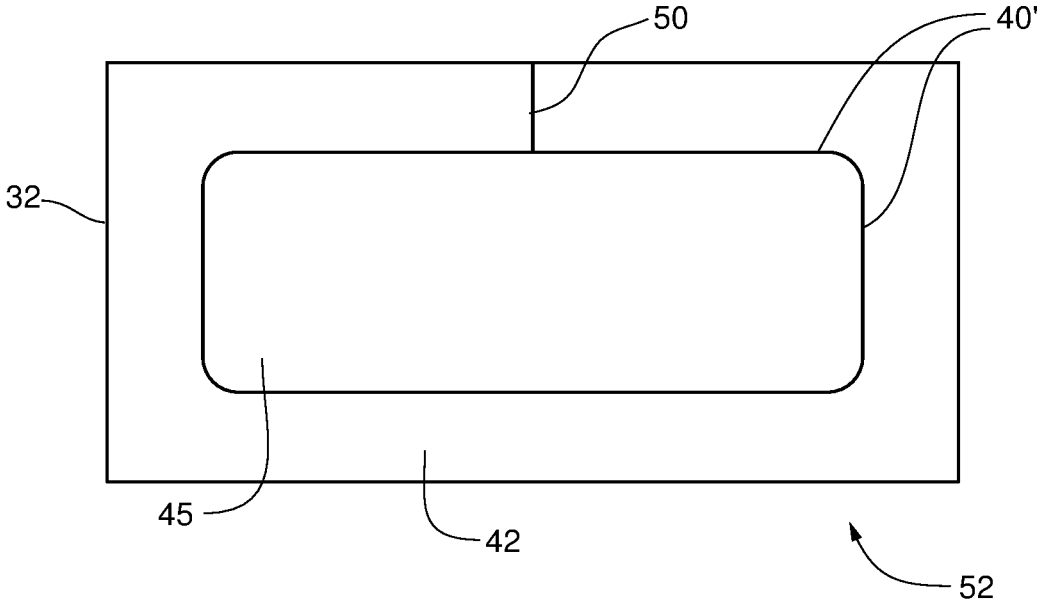
FIG. 3 is a top view of an embodiment of a top release liner forming a top layer of a perimeter seal device of the present disclosure.

In embodiments, as shown in FIGS. 3 and 9, for example, the perimeter cut 40' may be of a slightly different shape than of the face mask itself, for example, having a rectangular shape, but with rounded corners. For example, the perimeter cut 40' through each of the top release liner 32 and the middle adhesive layer 34, which is preferably centered to the edges of the top release liner 32 and middle adhesive layer 34, may be in a rectangular shape with rounded corners, which may be, in embodiments, of about ⅛" radius, or in other embodiments, ¼" radius, or in additional embodiments, about ½" radius rounded corners.

In still additional embodiments, the outer dimensions of the top release liner 32 and middle adhesive layer 34 are about 3.5"×7", being configured for a rectangular face mask of similar outer dimensions. The perimeter cut 40' through each of the top release liner 32 and the middle adhesive layer 34 is rectangular shaped and centrally located 0.5" inward from the edges of the outer dimensions, to form central portions 45. This forms an approximate 0.5" wide perimeter portion 42 in the form of a rectangular-shaped perimetral strip on the periphery of the top release liner 32 and middle adhesive layer 34, with, in embodiments, rounded corners of about ½" radius.

The perimeter cuts 40 shown in FIG. 2A, as well as the perimeter cuts 40' shown in FIG. 9, and the perimeter cuts 140 of the embodiment of FIG. 14, are preferably formed during manufacture after the three-layered structure is sandwiched together, by a kiss-cut made simultaneously through each of the top release liner 32 and middle adhesive layer 34.

In embodiments, the perimeter cut 40, 40', 140, may be positioned ½" in from the outer edges or perimeter of each of the top release liner 32 and the middle adhesive layer 34, forming a perimeter portion 42 in the top release liner 32 and a perimeter portion 38 in the middle adhesive layer 34, so that in embodiments, the perimeter portions 38, 42, are approximately ½" wide. The perimeter cut 40, 40', 140 also defines a central portion 45 which, in embodiments, is centered in the middle of each of the top release liner 32 and the middle adhesive layer 34. Accordingly, once the face mask 12 is assembled with, for example, the perimeter face seal device 30 of FIG. 2A or the embodiment 30' of FIG. 9, as further described herein, a ½" wide perimetral strip of adhesive will result all around the perimeter 18 of the user-facing side 10 of the face mask 12 for adhering to a user's face.

The device 30' of FIG. 9 differs from the device 30 shown in FIG. 2A in the shape of the perimeter cuts 40', which form central portions of rectangular-shape like those of FIG. 2A, but with rounded corners. The device 30' of FIG. 9 also differs in having the peel portion 60, which is adhesive-free, also referred to herein as a "dry peel portion," in the bottom release liner 36 along only one edge, in the example shown, along the left edge 56, rather than along both the left 56 and the right edge 58 of the top release liner 32 and adhesive layer 36 of the device 30, as shown in FIG. 2A. Similarly, the difference in the device 130 of FIGS. 14A-14B is driven by the particular shape of the oval or round-type face masks for which it is configured, so that, in this embodiment, the bottom release liner 36, in embodiments, particularly for round or oval face masks, is of the same shape as, but wider than, and centered to, the top release liner 32 and middle adhesive layer 34.

In embodiments, the bottom release liner 36 is sized to provide an approximate ¼" to ½" peel portion 60 all around the edges of the top release liner 32 and middle adhesive layer 34.

Figure 4:
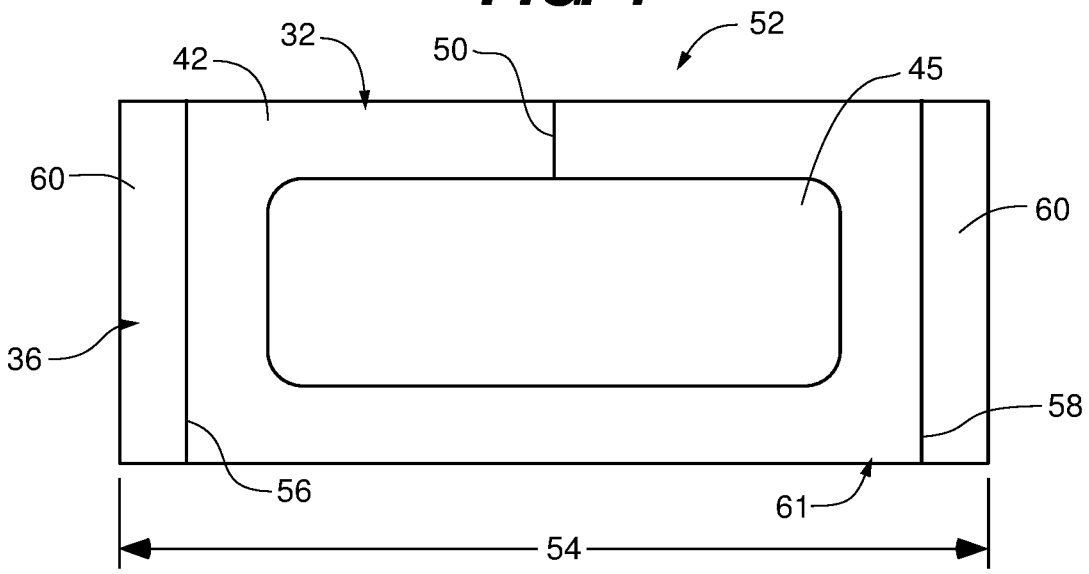
FIG. 4 is a top view of an embodiment of a perimeter seal device of the present disclosure having the three-layered structure of FIG. 2A, the top release liner of FIG. 3, and a central portion of the adhesive layer also having rounded corners, prior to assembly on a mask.

Referring to FIGS. 2A, 3-5, 9-11B, 12B-13B, and 14A-14B, the top release liner 32 also includes a cut 50 (referred to herein as a "crack-and-peel cut"), which provides a crack-and-peel edge 51 (FIGS. 5, 13B) for peeling. The cut 50 extends only through the top release liner 32, and only across the perimeter portion 42. The cut 50 extends across a width of the perimeter portion 42, i.e., from a perimetral edge 61 to the perimeter cut 40 in the top release liner 42. In embodiments, the crack-and-peel cut 50 may be centered along a wider side of the top release liner 32, which may, in embodiments, correspond to the center of a wider side 52 of the perimeter seal device 30, as shown in FIG. 4, for example.

Like the perimeter cuts 40, the crack-and-peel cut 50 is preferably formed during manufacture after the three-layered structure is sandwiched together, by a kiss-cut made only through the top release liner 32 and not through the adhesive layer 34.

Referring to FIGS. 2A, 4, 5, 6 and 7, as well as to the embodiments of FIGS. 9-13B, and FIGS. 14A-14B, the bottom release liner 36 preferably extends beyond a perimeter 61 (also referred to as a "perimetral edge 61") of each of the top release liner 32 and middle adhesive layer 34 of the perimeter seal device for easy removal during assembly of the perimeter seal device to a face mask. In embodiments, referring to FIG. 2A, as well as to the embodiment of FIGS. 14A-14B, the bottom release liner 36 may be centered to the top release liner 32 and middle adhesive layer 34 and extend beyond the widths of each of top 32 and middle layers 34.

In embodiments, referring to the device 130 of FIGS. 14A-14B, the bottom release liner 36 has a greater width along at least one of the axes of the oval, and in the case of a circular device, the bottom release liner 36 may have a greater diameter than that of the top 32 and middle layers 34.

Figure 6:
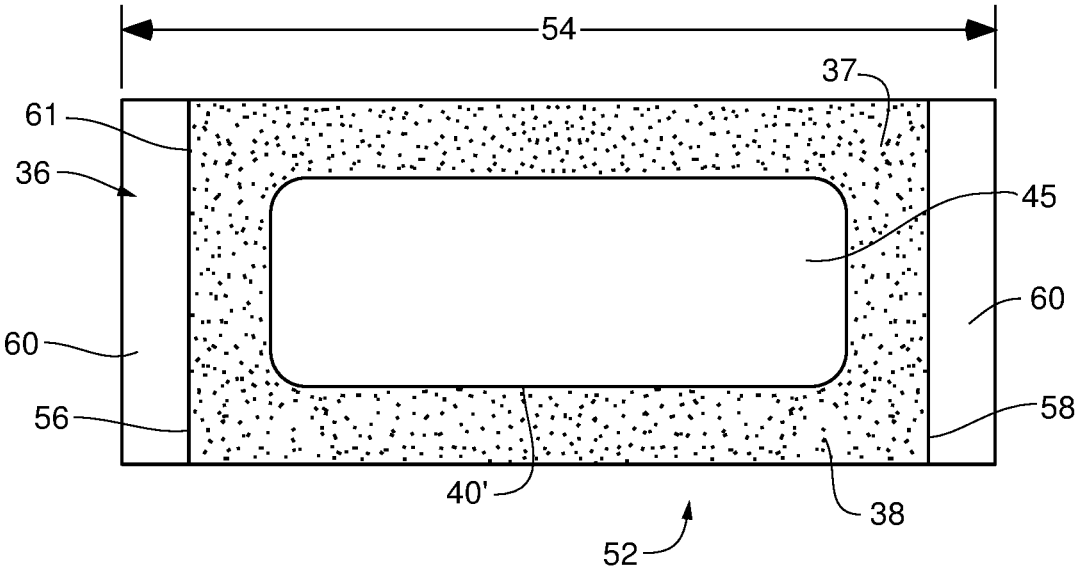
FIG. 6 is a pictorial representation of FIG. 5 with the perimeter portion of the top release layer completely removed, revealing a mask-facing side of the perimeter portion of the adhesive layer.

In embodiments, referring again to FIGS. 2A and 4, for example, the bottom release liner 36 may extend in width 54, e.g., along the wider side 52 of a rectangularly shaped top release liner 32 and middle adhesive layer 34, beyond both the left 56 and right edges 58 of the top release liner 32 and middle adhesive layer 34. As best shown in FIG. 6, this leaves a peel portion 60 that extends beyond a perimeter 61, or perimetral edge 61, of the middle adhesive layer 34, and in embodiments, of the top release liner 32, along each side 56, 58, of the perimeter seal device 30.

In other embodiments, as shown in FIGS. 9-11B, the bottom release liner 36 preferably extends beyond at least one edge, e.g., the left edge 56 of each of the top 32 and middle layers 34 of the perimeter seal device, leaving a dry peel portion 60 along, for example, the left edge 56.

In embodiments, each dry peel portion 60 may be about ¼" wide. In embodiments, the dry peel portion 60 is between about ¼" and ½" wide.

Various methods may be used to transfer and adhere the perimeter portion 38 of the adhesive layer 34 of a perimeter face mask seal device of the present disclosure to a face mask for forming a perimeter face mask seal. FIGS. 5-8B represent an embodiment of a method for converting a non-sealed face mask to a face mask with a perimeter seal, or for providing a face mask with a perimeter seal, with reference to the embodiment of the device 30 represented by FIGS. 2A-4, and may also be applied to the three-layered structure 25 of device 30' shown in FIGS. 9 and 10, and of device 130 of FIGS. 14A-14B.

Figure 5:
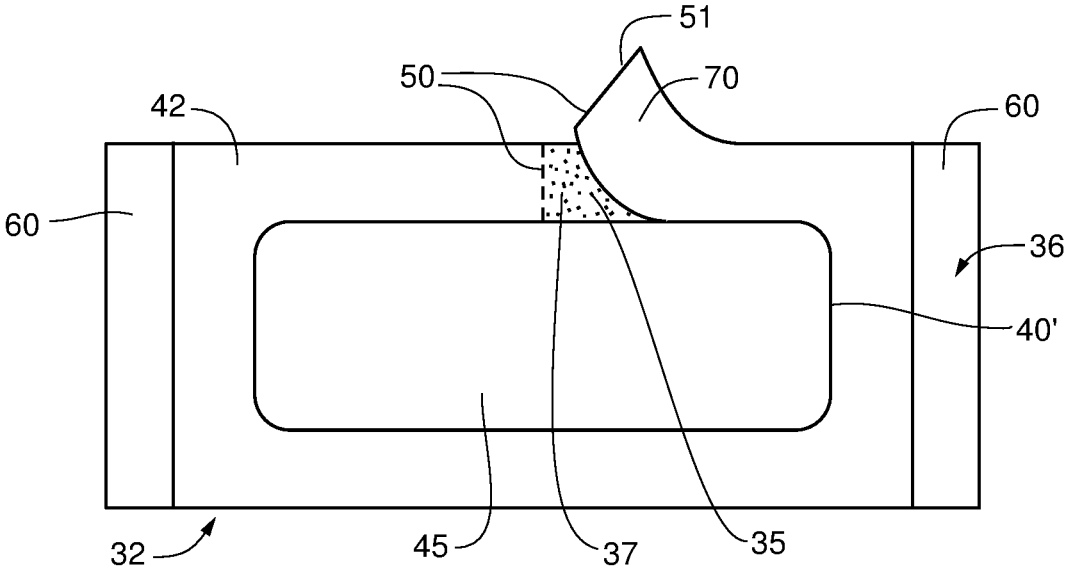
FIG. 5 is a pictorial representation of the perimeter seal device of FIG. 4 with an edge of a perimeter portion of the top release layer lifted up for peeling and removal, revealing a perimeter portion of an adhesive layer below.
Figure 8A:
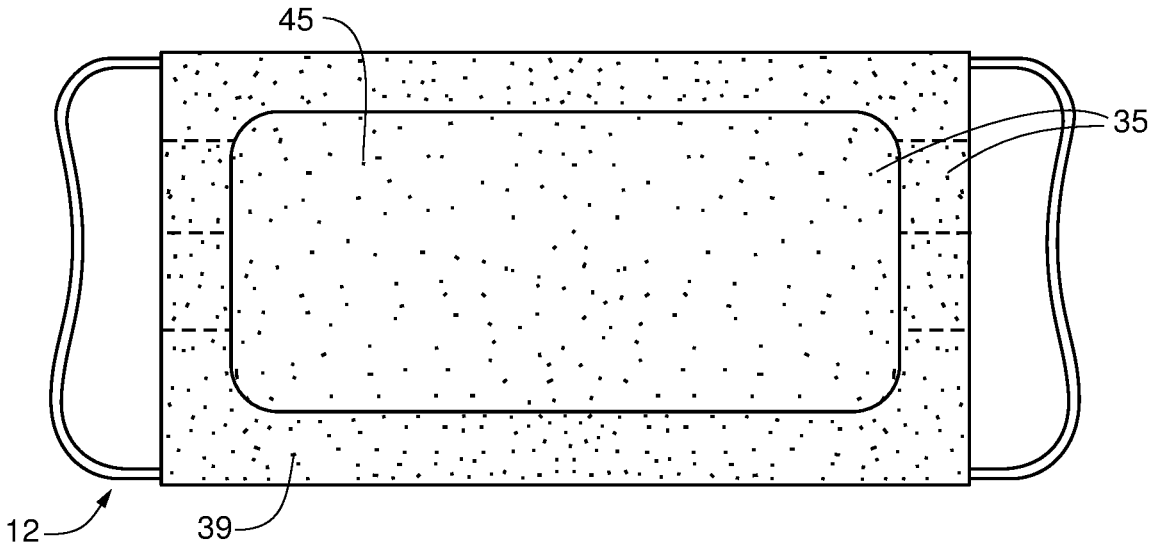
FIG. 8A is a view of the user-facing side of the face mask of FIG. 1 showing the perimeter portion of the adhesive layer of FIG. 6 remaining on the face mask along with a central portion of both the top release liner and adhesive layer of the perimeter seal device of FIGS. 4-7 after removal of the bottom release liner.
Figure 8B:
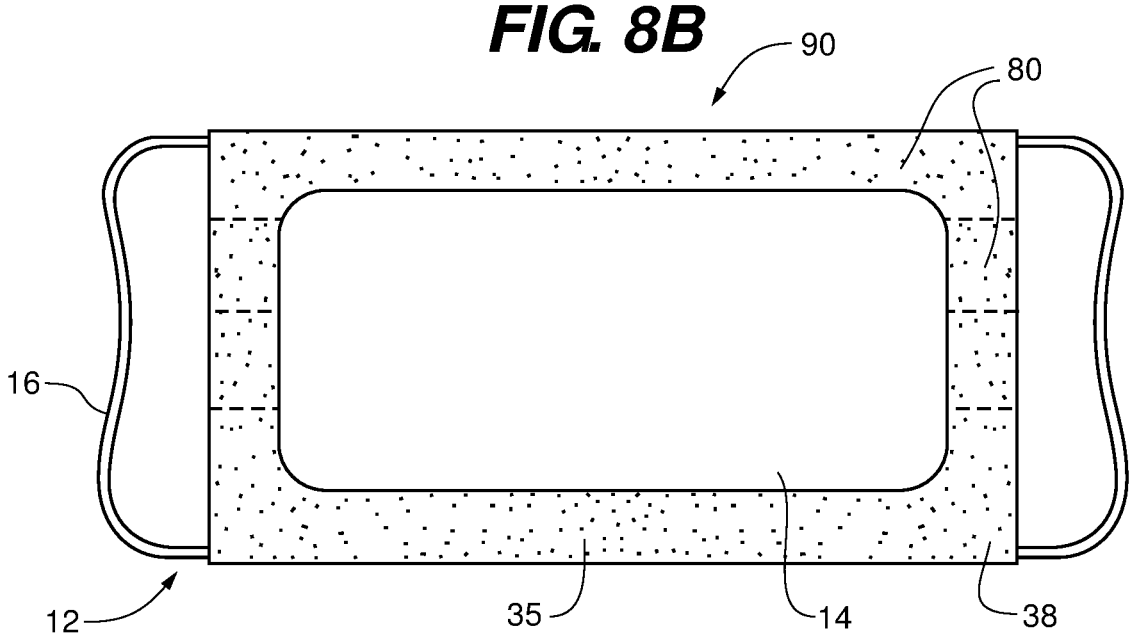
FIG. 8B is a view of the user-facing side of the face mask of FIG. 8A, with the central portion of the perimeter seal device of FIG. 8A removed, showing the perimeter seal for adhering the face mask to a user for use.
Figure 15:
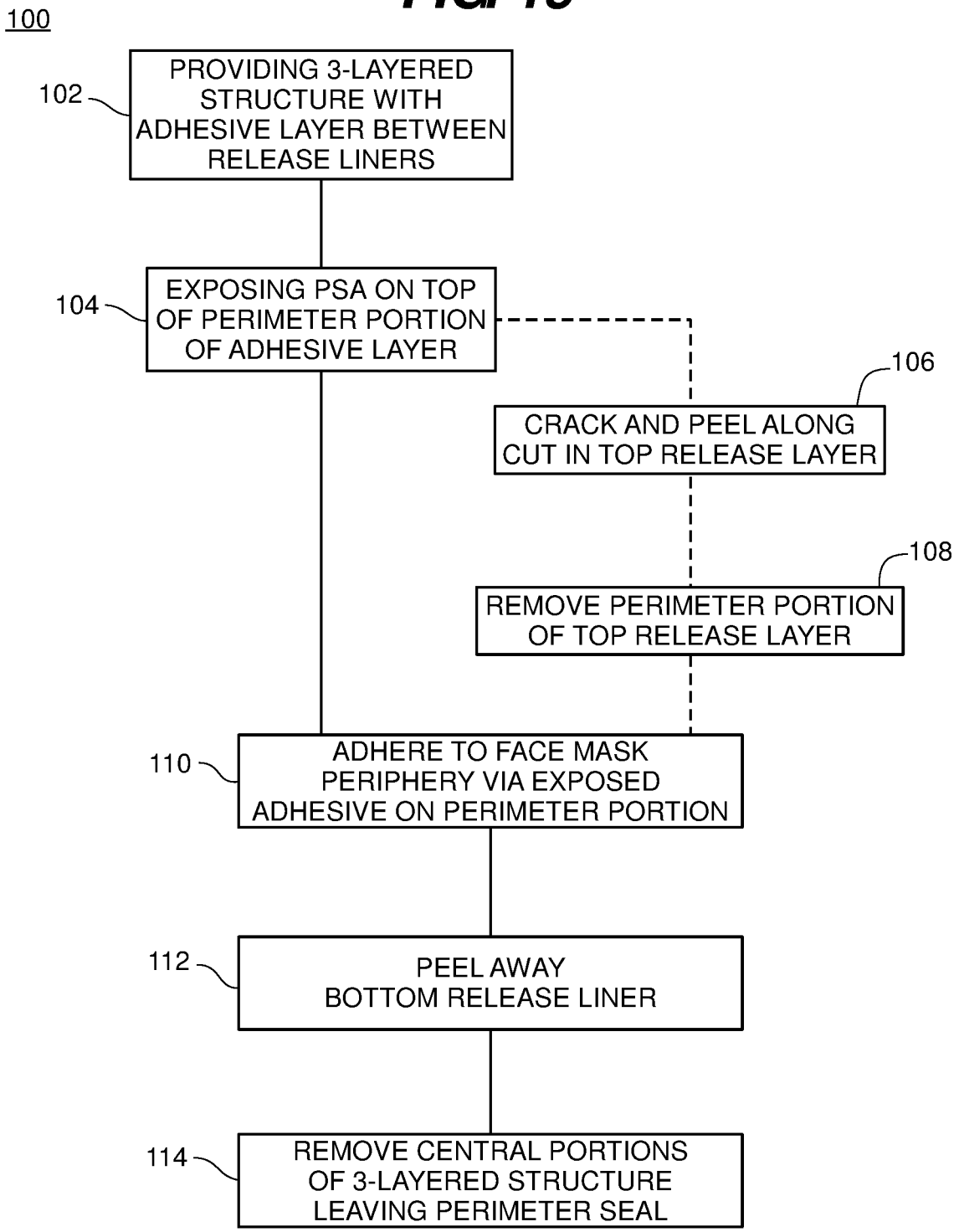
FIG. 15 is a flow diagram representation of an embodiment of a method for converting a non-sealed face mask to a face mask with a perimeter seal, using any of the embodiments of a face mask formed in accordance with the present disclosure.

With reference to FIGS. 4 and 5, which are top views of an embodiment of the assembled three-layered structure 25 of FIGS. 2A and 3, embodiments of a method 100, as disclosed in FIG. 15, for converting the face mask 12 to a face mask 90 with a perimeter seal 80 as shown in FIG. 8B includes providing, at 102, the three-layered structure 25 of an embodiment of the perimeter seal for a face mask in accordance with the present disclosure, and exposing, at 104, the pressure-sensitive adhesive 35 on the upper surface 37 of the perimeter portion 38 of the middle adhesive layer 34, which includes, in embodiments, cracking and peeling back, at 106, an edge portion 70 of the perimeter portion 42 of the top release liner 32 along the crack-and-peel cut 50, and continuing peeling until the perimeter portion 42 of the top release liner 32, at 108, is completely removed, as shown in FIG. 6. This exposes the adhesive 35 on the upper surface 37 of the perimeter portion 38 of the middle adhesive layer 34. In this embodiment of a method for converting a non-sealed face mask to a face mask with a perimeter seal, the upper surface 37 of the perimeter portion 38 is a mask-facing side of the perimeter seal device 30.

As further described herein, after exposing the upper surface 37 of the perimeter portion 38 of the adhesive layer 34, at 104, as shown in FIG. 6, the perimeter portion 38, with the remaining central portions 45 and bottom release liner 36 of the three-layered structure 25 still attached thereto, is adhered, at 110, to the face mask. In particular, after aligning the perimeter portion 38 to the perimeter 18 of the face mask, with the exposed PSA 35 facing the user-facing side of the face mask 12, the adhering step, at 110, includes pressing, or applying pressure on the bottom release liner 36 side of the device 30 to adhere the perimeter portion 38 around the perimeter 18 of the user-facing side 10 of the face mask 12, as shown, for example, in FIG. 7. In this view, in which the upper surface 37 of the perimeter portion 38 of the adhesive layer 34 is adhered to the user-facing side 10 of the face mask 12, only the bottom surface 72 (see also FIGS. 2A, 9, 14B) of the bottom release layer 36 can be seen. It should be clear that the exposed adhesive 35 in the upper surface 37 of the perimeter portion 38 is adhered to the perimeter 18 of the face mask 12, so that the bottom release layer 36 portion(s) 60 that extend beyond the adhesive layer 34 likewise extend beyond the edges 18 of the mask 12 in this assembly step.

Figure 7:
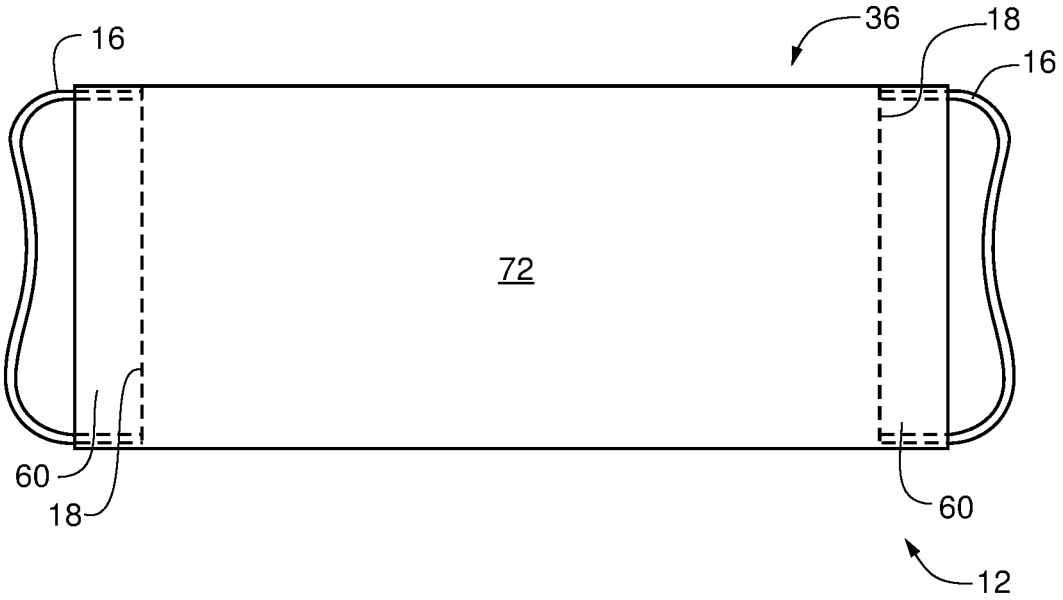
FIG. 7 is a view from a bottom surface of a bottom release liner of remaining portions of the perimeter seal device of FIG. 6, after removing the perimeter portion of the top release layer, with the perimeter portion of the adhesive layer shown in FIG. 6 adhered to the user-facing side of the prior art face mask of FIG. 1.

Once the device 30, for example, is pressed onto the user-facing side 10 of the face mask 12, adhering, at 110, the exposed adhesive 35 in the upper surface 37 of the middle adhesive layer 34 to the perimeter 18 of the face mask 12 as shown in FIG. 7, the bottom release liner 36, which is preferably one continuous sheet, is peeled away, at 112, and discarded. Referring to FIG. 8A, this exposes the adhesive 35 on the lower surface 39 of the middle adhesive layer 34, including along the perimeter portion 38, to form a user-facing side of the perimeter portion 38 for adhering to a wearer's face. As shown in FIG. 8A, the adhesive 35 on the lower surface 39 of the central portion 45 of the middle adhesive layer 34 is also exposed after removing the bottom release liner, with the central portion 45 of the middle adhesive layer 34 and the central portion 45 of the top release liner 32 still remaining intact.

In a final step of this embodiment of a method for converting the face mask 12 to a face mask with a perimeter seal, the remaining central portion 45 of each of the top release liner 32 and the middle adhesive layer 34 attached thereto, at 114, are removed, preferably in one step, leaving only the perimeter portion 38 of the middle adhesive layer 34 adhered to the face mask 12 via the pressure sensitive adhesive 35 on the upper surface 37 of the perimeter portion 38. The adhesive 35, now exposed, on the lower surface 39 of the perimeter portion 38, see FIG. 8B, is the user-facing side of the perimeter portion 38 of the adhesive layer 34 in this embodiment, and provides a perimeter seal 80 on the face mask 12 for adhering to a user's face.

After applying the method to form a face mask 90 with a perimeter seal from non-sealed face mask 12, the perimeter 18 of face mask 12 is adhered via the perimeter adhesive seal 80 directly to a user's face to seal the perimeter 18 of the face mask 12 tight to the wearer's face.

For simplicity, the method 100 is described herein with reference to certain embodiments of a face mask perimeter seal device; however, it should be appreciated that any of the embodiments of methods of the present disclosure can be applied using any embodiment of a perimeter seal device including the three-layered structure as shown and described herein, and equivalents thereof, including those shown herein.

Figure 16:
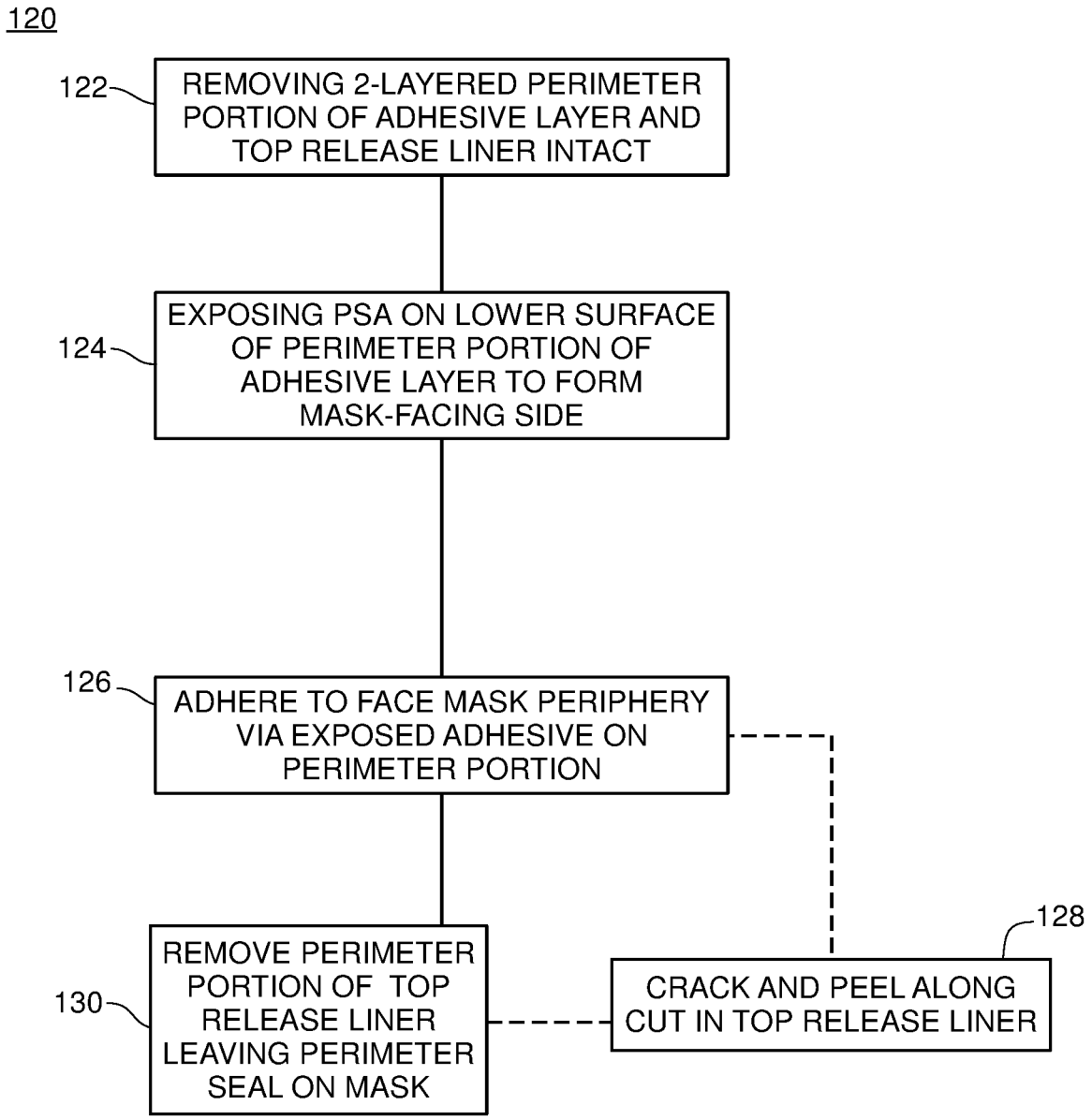
FIG. 16 is a flow diagram representation of another embodiment of a method for converting a non-sealed face mask to a face mask with a perimeter seal, using any of the embodiments of a face mask formed in accordance with the present disclosure.

Referring to FIG. 16, another embodiment of a method for converting a non-sealed face mask to a face mask with a perimeter seal, using a face mask seal device, is described with reference to the embodiment of the device 30' represented by FIGS. 9 and 10.

It will be appreciated that in the method represented by FIG. 15, described herein in reference to FIGS. 2A-8B, the upper surface 37 of the perimeter portion 38 of the middle adhesive layer 34 forms the face mask-facing side that is adhered to the face mask and, referring to FIG. 8B, the lower surface 39 of the perimeter portion 38 of the middle adhesive layer 34 forms the perimeter seal 80 for adhering the face mask to a user's face. In the method represented by FIG. 16, described herein below with reference to FIGS. 10-13C, the lower surface 39 of the perimeter portion 38 of the middle adhesive layer 34 forms the mask-facing side that is adhered to the face mask and, referring to FIG. 13C, the upper surface 37 of the perimeter portion 38 of the middle adhesive layer 34 forms the perimeter seal 80' for adhering the face mask with the perimeter seal 90' of FIG. 13C to a user's face. Either method can be applied to any embodiment of a face mask seal device described herein and equivalents thereof.

Figure 10:
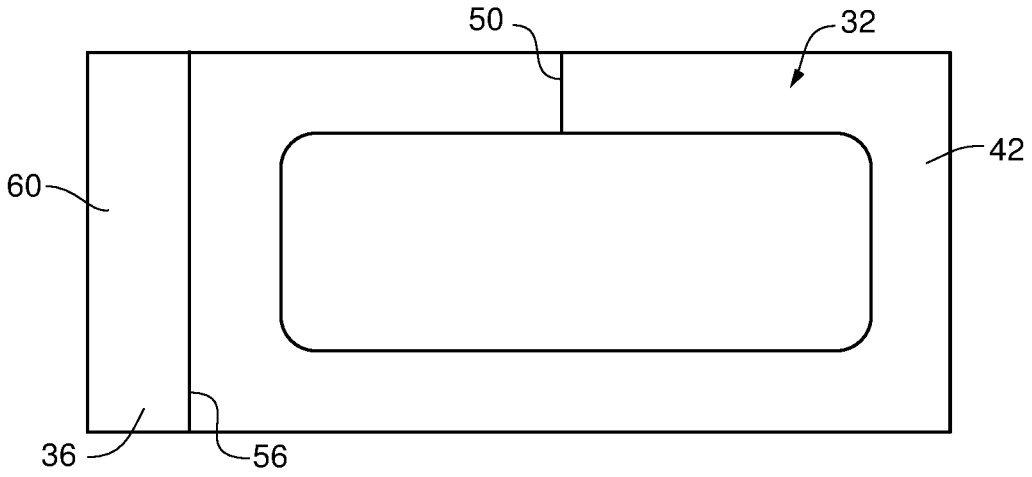
FIG. 10 is a top view of the perimeter seal device of FIG. 9 prior to assembly to a face mask.
Figure 11A:
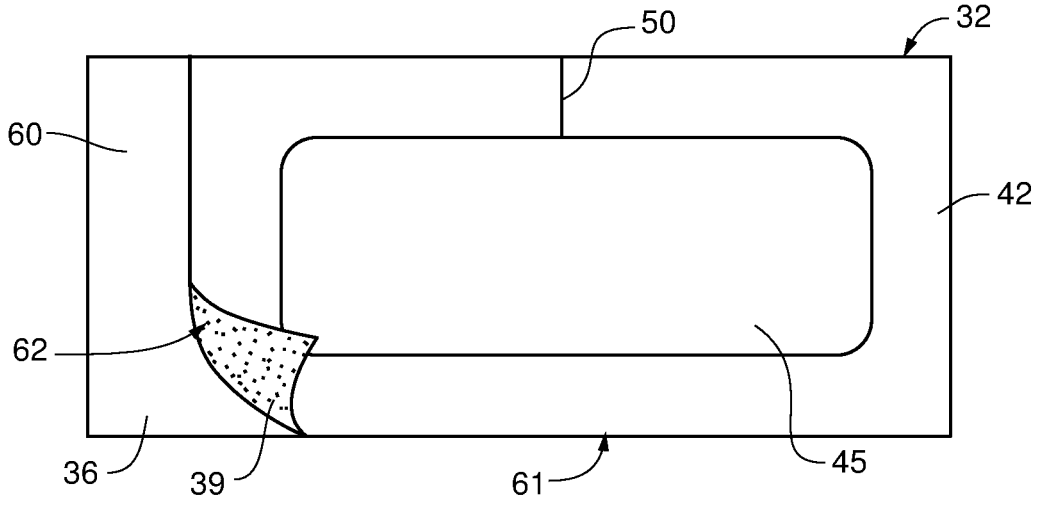
FIG. 11A is a pictorial representation of both a perimeter portion of the top release liner together with a perimeter portion of a middle adhesive layer, referred to as a two-layer perimetral strip portion, being peeled off of a bottom release liner, revealing a portion of a lower surface of the middle adhesive layer.
Figure 11B:
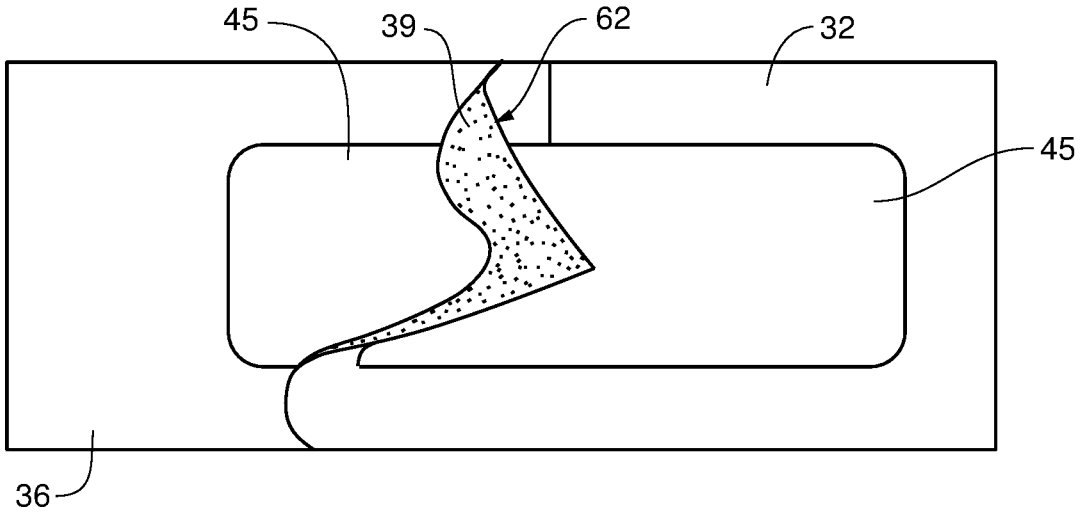
FIG. 11B is a pictorial representation of the process of removing the two-layer perimetral strip portion of FIG. 11A intact from the bottom release liner, revealing more of the lower surface of the middle adhesive layer being pulled off of the bottom release liner.

Referring to FIG. 16, an embodiment 120 of another method for converting a non-sealed face mask to a face mask with a perimeter seal, with reference to FIGS. 10-12C, includes removing intact, at 122, a two-layer perimetral strip portion 62, which includes the perimeter portion 42 only of the top release liner 32 together with the perimeter portion 38 only of the middle adhesive layer 34, from the bottom release liner 36, and disposing of the central portions 45 together with the bottom release liner 36. Referring to FIGS. 10 and 11A, removal of the two-layer perimetral strip portion 62 is facilitated by the dry peel portion 60 of the release liner 36, the two-layer perimetral strip portion 62 being easier to lift at a corner of the two-layer perimetral strip portion 62 adjacent the dry peel portion 60, as shown in FIG. 11A. FIG. 11B illustrates the two-layer perimetral strip portion 62 being separated from the central portions 45 of both the top release liner 32 and the middle adhesive layer 34 and peeled off of the bottom release liner 36. A user may push down on the central portion 45 while lifting the two-layer perimetral strip portion 62 to easily separate it from the central portion 45. As previously described, in embodiments, two peel portions 60 are provided along two edges 56, 58 of the adhesive layer 34, the adhesive layer 34 and the top release liner 32 in embodiments being centered on the bottom release liner 36 to form the two peel portions 60 (see FIG. 6, e.g.).

Figure 12A:
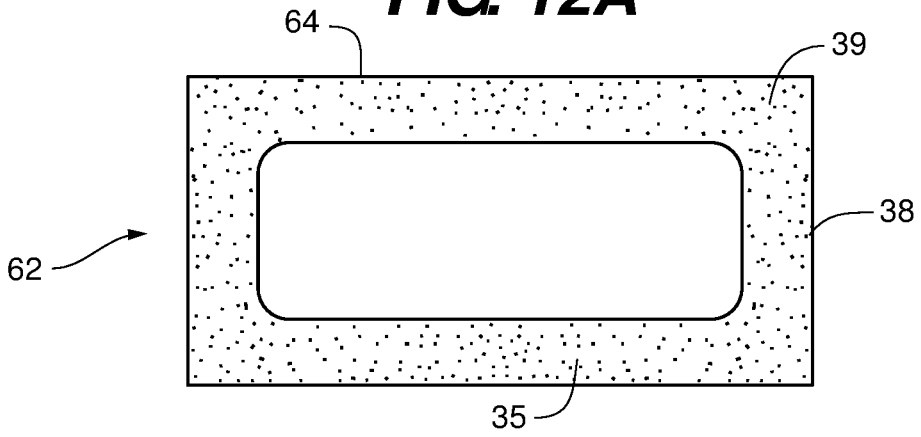
FIG. 12A is a view of a mask-facing side of the two-layer perimetral strip portion after removal as shown in FIG. 11B showing the lower surface adhesive exposed for adhering to a face mask.
Figure 12B:
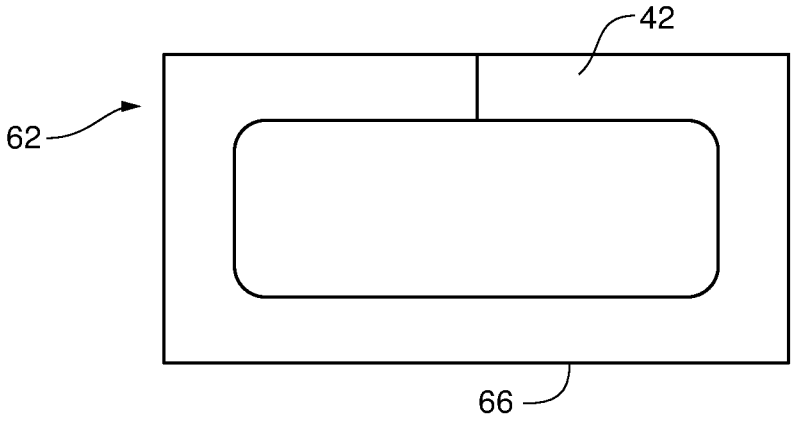
FIG. 12B is a view of a top release-liner side of the two-layer perimetral strip portion after removal from the bottom release liner as shown in FIG. 11B.
Figure 12C:
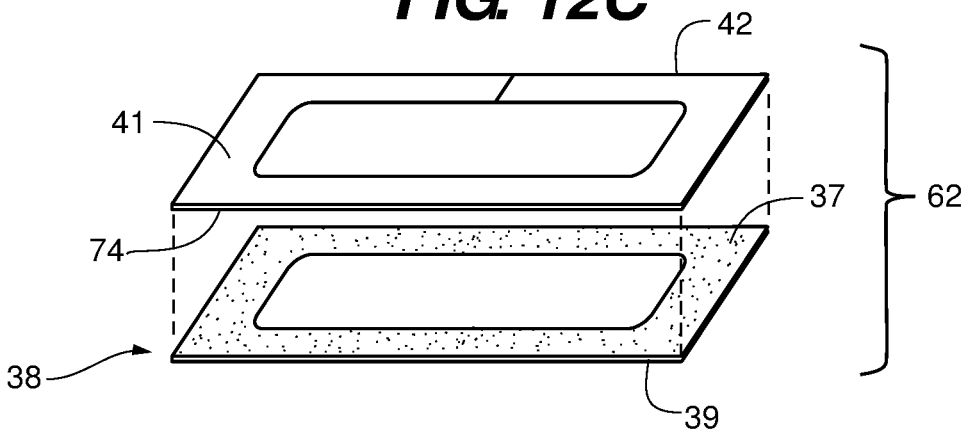
FIG. 12C is an exploded view of the two-layer perimetral strip portion of FIGS. 12A and 12B, after removal from the bottom release liner as shown in FIG. 11B.

As best shown in FIG. 12C, referring also to FIG. 9, as a result of peeling off the two-layer perimetral strip portion 62, the pressure-sensitive adhesive 35 on the lower surface 39 of the perimeter portion 38 of the middle adhesive layer 34 is exposed, at 124, on a bottom surface 64 of the separated two-layer perimetral strip portion 62, which is shown in FIG. 12A, to form the mask-facing side that is adhered to a face mask, the bottom surface 64 forming the mask-facing side in this embodiment of a method for forming a perimeter seal for a face mask. The perimeter portion 42 of the top release liner 32 forms a top surface 66 of the two-layer perimetral strip portion 62, as shown in FIGS. 12B and 12C.

Figure 13A:
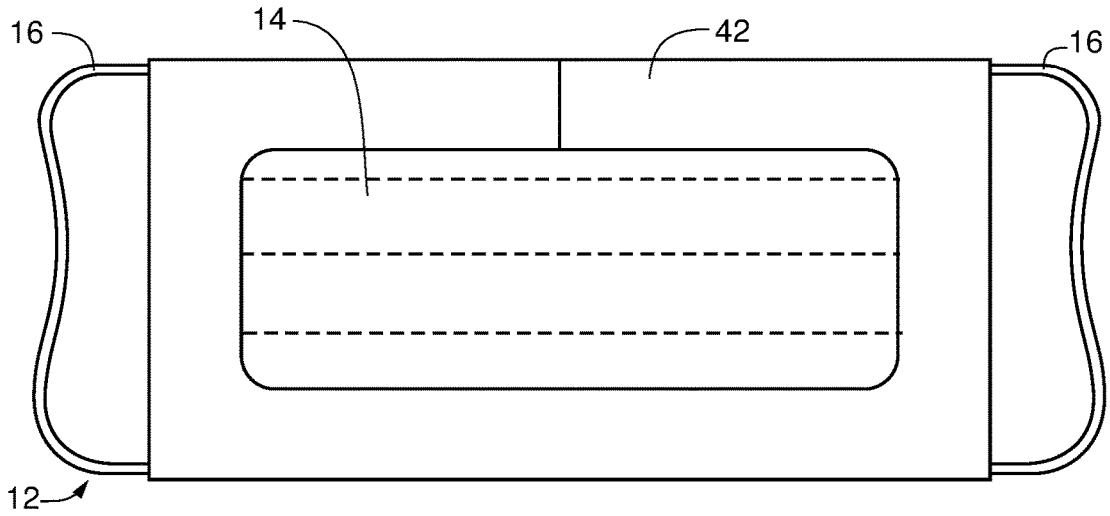
FIG. 13A is a view of the user-facing side of the face mask of FIG. 1, with the mask-facing side of the two-layer perimetral strip portion shown in FIG. 12A adhered to the perimeter of the face mask.

At 126, referring to FIG. 16, the two-layer perimetral strip portion 62 is adhered to the face mask 12, as shown in FIG. 13A, via the pressure-sensitive adhesive 35 on the bottom surface 64 of the two-layer perimetral strip portion 62, by aligning the two-layer perimetral strip portion 62 to the perimeter 18 of the face mask, with the bottom surface 64 contacting the face mask 12, and applying pressure to the top surface 66.

Figure 13B:
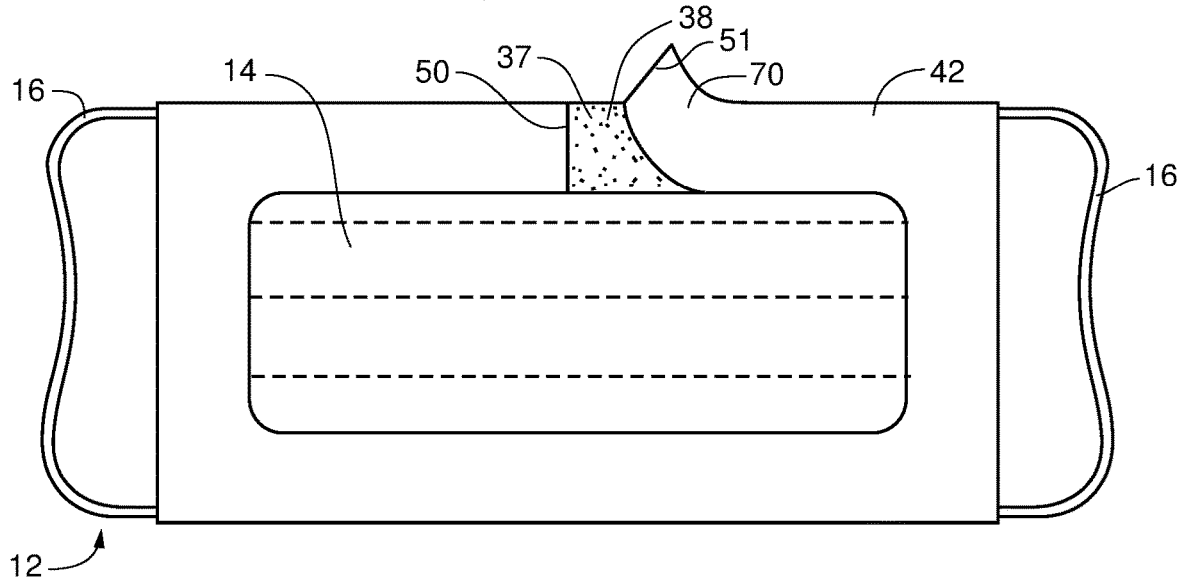
FIG. 13B is a view of FIG. 13A with an edge of a perimeter portion of the top release liner lifted up for peeling and removal of the perimeter portion.

At 130, referring to FIGS. 16 and 13B, the perimeter portion 42 is then removed to expose PSA 35 from the upper surface 37 of the perimeter portion 38 of the middle adhesive layer 34. As shown in FIG. 13B, removing the perimeter portion 42 includes, in embodiments, cracking and peeling back, at 128, edge portion 70 of the perimeter portion 42 of the top release liner 32 along the crack-and-peel cut 50, and continuing peeling until the perimeter portion 42 of the top release liner 32, at 128, is completely removed, as shown in FIG. 13C.

Figure 13C:
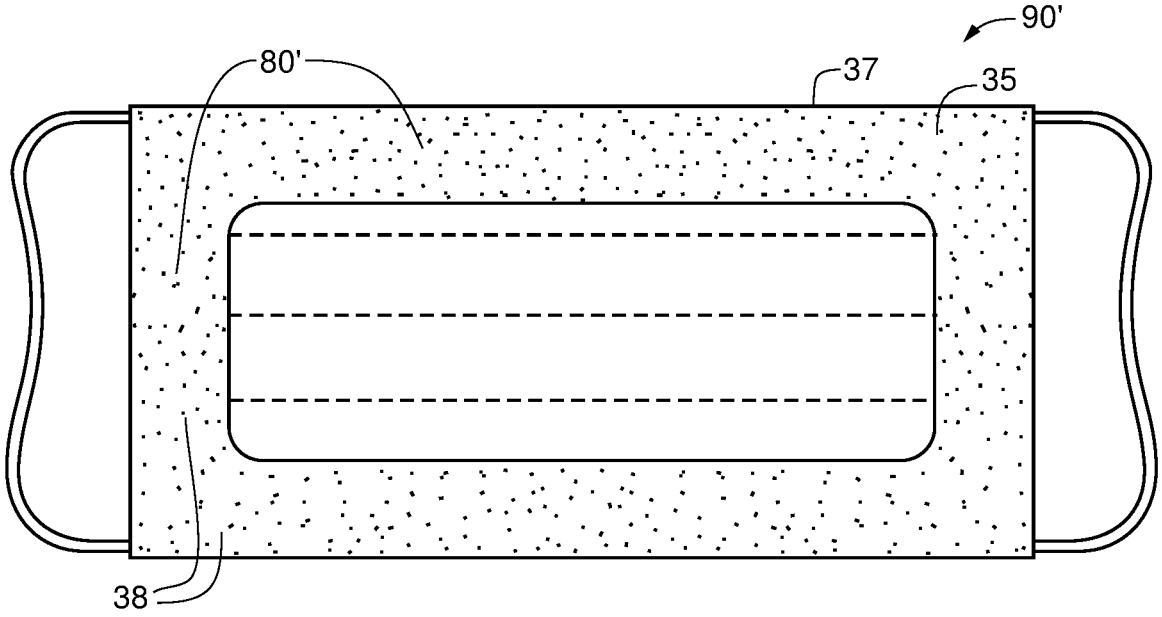
FIG. 13C is a view of FIG. 13B with the perimeter portion of the top release liner completely removed, exposing an upper surface of the perimeter portion of the middle adhesive layer which forms a user-facing adhesive side for adhering the perimeter seal to a user.

Referring to FIG. 13C, the upper surface 37 of the perimeter portion 38 of the middle adhesive layer 34 forms the user-facing side of the perimeter seal 80' for adhering the face mask 90' of FIG. 13C to a user's face. The face mask with perimeter seal 80 or 80' adhered thereto, as shown in FIG. 8B or FIG. 13C, is then adhered to the perimeter of a wearer's face.

The perimeter seal 80, 80' of the present disclosure closes air gaps between the face mask and the face in use, blocking, or at least minimizing, unfiltered air from leaking in around the perimeter of the face mask. The result is that air flow is directed through the front of the mask, and is thus filtered through filtering media 14, before reaching the wearer. In a recent test, the inventors demonstrated that half the wearers of a Level 3 ear loop mask with a perimeter seal of the present disclosure passed the fit test required of an N95 respirator. Accordingly, the perimeter seal device of the present disclosure provides a cost-efficient, easy to apply, seal for applying to the perimeter of a manufactured face mask, such as a surgical mask, or ear-loop mask, which improves the filtering efficiency of a commercial, otherwise non-sealed face mask.

While the invention has been particularly shown and described with reference to specific embodiments, it should be apparent to those skilled in the art that the foregoing is illustrative only, not limiting, and presented by way of example only. The disclosed embodiments may be embodied in various forms and detail without departing from the spirit and scope of the disclosure. Therefore, specific structural and functional details disclosed herein are not to be interpreted as limiting. Numerous other embodiments may fall within the scope of the accompanying claims and equivalents thereto.

What is claimed is:

1. A perimeter seal device for forming a perimeter seal for a face mask, the device comprising:

a top release liner, the top release liner including a perimeter portion and a central portion defined by a perimeter cut therebetween;

an adhesive layer including a carrier with an upper surface and a lower surface, and a pressure-sensitive adhesive coated on each of the upper surface and the lower surface, wherein the perimeter cut also extends through the adhesive layer to define a perimeter portion and a central portion in the adhesive layer aligned with the perimeter portion and the central portion of the top release liner; and a bottom release liner, wherein the adhesive layer is sandwiched between the top release liner and the bottom release liner, the perimeter cut extending through only the top release liner and the adhesive layer and not through the bottom release liner, and wherein the perimeter portion of the adhesive layer is separable from each of the central portion of the adhesive layer, the top release liner, and the bottom release liner to form a perimeter seal for a face mask.

2. The perimeter seal device of claim 1, wherein the bottom release liner includes a peel portion that extends beyond a perimeter of the adhesive layer, wherein the peel portion is adhesive-free.

3. The perimeter seal device of claim 2, wherein each of the top release liner, the adhesive layer, and the bottom release liner is rectangular-shaped, the peel portion extending beyond the perimeter of the adhesive layer along at least one edge of the adhesive layer.

4. The perimeter seal device of claim 3, wherein the bottom release liner is centered to the upper release liner and the adhesive layer, the peel portion extending beyond two edges of the adhesive layer.

5. The perimeter seal device of claim 2, wherein each of the top release liner, the adhesive layer, and the bottom release liner is oval-shaped.

6. The perimeter seal device of claim 1, wherein the top release liner includes a cut therethrough and not extending through the adhesive layer, the cut providing a crack-and-peel edge, the cut extending from a perimetral edge of the top release liner to the perimeter cut.

7. The perimeter seal device of claim 6, wherein the bottom release liner includes a peel portion that extends beyond a perimeter of the adhesive layer, wherein the top release liner is silicone-coated on a lower surface, and the bottom release liner is silicone-coated on an upper surface, wherein the carrier of the adhesive layer is formed of polyethylene and the pressure-sensitive adhesive includes a medical grade acrylic.

8. The perimeter seal device of claim 1, wherein the carrier is a stretchable plastic film.

9. The perimeter seal device of claim 1, wherein each of the top release liner and the bottom release liner includes one of a paper sheet and a plastic film, silicone-coated on one side, wherein the top release liner is silicone-coated on a lower surface, and the bottom release liner is silicone-coated on an upper surface, and wherein one of an upper surface of the top release liner and a bottom surface of the bottom release liner includes a two-dimensional bar code printed thereon.

10. The perimeter seal device of claim 1, wherein the perimeter seal device is configured to adhere either one of the upper surface and the lower surface of the perimeter portion of the adhesive layer to the face mask to form the perimeter seal on the face mask.

* * * * *